US008019103B2

(12) United States Patent
Kates

(10) Patent No.: US 8,019,103 B2
(45) Date of Patent: Sep. 13, 2011

(54) HEARING AID WITH SUPPRESSION OF WIND NOISE

(75) Inventor: James Mitchell Kates, Niwot, CO (US)

(73) Assignee: GN ReSound A/S (DK)

( * ) Notice: Subject to any disclaimer, the term of this patent is extended or adjusted under 35 U.S.C. 154(b) by 1271 days.

(21) Appl. No.: 11/497,664

(22) Filed: Aug. 1, 2006

(65) Prior Publication Data

US 2007/0030989 A1 Feb. 8, 2007

(30) Foreign Application Priority Data

Aug. 2, 2005 (DK) ..... 2005 01107

(51) Int. Cl.
*H04R 25/00* (2006.01)

(52) U.S. Cl. ..... 381/317; 381/94.2; 381/320; 381/321

(58) Field of Classification Search ..... 381/313, 381/317, 94.3, 320–321
See application file for complete search history.

(56) References Cited

U.S. PATENT DOCUMENTS

| | | | | |
|---|---|---|---|---|
| 5,550,925 | A * | 8/1996 | Hori et al. | 381/98 |
| 5,574,791 | A * | 11/1996 | Orban | 381/98 |
| 6,606,391 | B2 * | 8/2003 | Brennan et al. | 381/316 |
| 7,155,019 | B2 * | 12/2006 | Hou | 381/92 |
| 7,587,254 | B2 * | 9/2009 | Kirkeby et al. | 700/94 |
| 7,876,918 | B2 * | 1/2011 | Luo | 381/317 |
| 2004/0167777 | A1 * | 8/2004 | Hetherington et al. | 704/226 |
| 2005/0078842 | A1 * | 4/2005 | Vonlanthen et al. | 381/312 |

FOREIGN PATENT DOCUMENTS

| | | | |
|---|---|---|---|
| EP | 1 448 016 | A1 | 8/2004 |
| EP | 1 519 626 | A2 | 3/2005 |
| WO | WO 03/019532 | A1 | 3/2003 |

OTHER PUBLICATIONS

S.F. Boll:"Suppression of Acoustic Noise in Speech Using Spectral Subtraction", IEEE Transactions on Accoustics, vol. ASSP-27, No. 2 Apr. 1979.

Wuttke, J., "Microphones and the wind", J. Audio Eng. Soc, vol. 40, pp. 809-817, 1991.

Dillon, H., Roe, I., and Ketch, R. (1999), "Wind noise in hearing aids: Mechanisms and measurements", Nat. Acoustic Labs Australia, Report to Danavox, Phonak, Oticon, and Widex, Jan. 13, 1999.

PP Vaidyanathan "Multirate systems and filter banks" Prentice Hall PTR 1993 (ISBN 0-13-605718-7) pp. 353-391.

* cited by examiner

*Primary Examiner* — Curtis Kuntz
*Assistant Examiner* — Ryan Robinson
(74) *Attorney, Agent, or Firm* — Vista IP Law Group, LLP

(57) ABSTRACT

The present application relates to a hearing aid with suppression of wind noise wherein wind noise detection is provided involving only a single comparison of the input signal power level at first low frequencies with the input signal power level at frequencies that may include the first low frequencies whereby a computational cost effective and simple wind noise detection is provided. The determination of relative power levels of the input signal reflects the shape of the power spectrum of the signal, and the detection scheme is therefore typically capable of distinguishing music from wind noise so that attenuation of desired music is substantially avoided.

23 Claims, 10 Drawing Sheets

The one-microphone wind-noise suppression system.

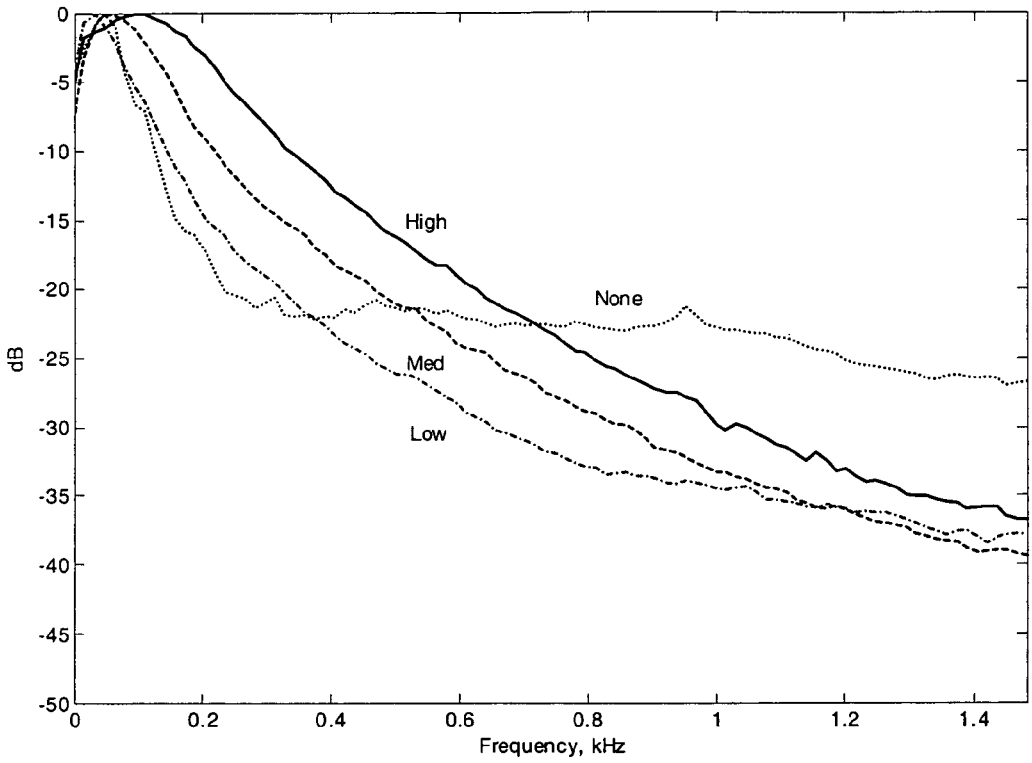

Average front-microphone power spectra for different intensities of wind noise from the data of Larsson and Olsson (2004). High intensity is indicated by the solid black line, medium by the dashed blue line, low by the dot-dash red line, and no wind by the doted black line. Ten sound files from recordings made in the city of Lund were averaged for each condition. The average spectra were normalized so that each curve has a peak value of 0 dB.

Fig. 2

Long-term frequency-warped power spectrum for a section of the "Rainbow Passage" spoken by a male talker. The spectrum is normalized to place the maximum band amplitude at 0 dB.

Long-term frequency-warped power spectra for sections of the 1-microphone and 2-microphone wind-noise recordings of Christensen (2003). The spectra are normalized to place the maximum band amplitudes of each spectrum at 0 dB.

Fraction of the total signal power found in the lowest-frequency warped FFT band for a section of the "Rainbow Passage" spoken by a male talker.

Fraction of the total signal power found in the lowest-frequency warped FFT band for sections of the 1-microphone and 2-microphone wind-noise recordings of Christensen (2003).

The one-microphone wind-noise suppression system.

The one-microphone wind-noise suppression system implemented using the warped system.

Long-term frequency-warped power spectrum for a segment of automobile traffic noise. The spectrum has been normalized to place the maximum band amplitude at 0 dB.

Fraction of the total signal power found in the lowest-frequency warped FFT band for a segment of automobile traffic noise.

The adaptive gain two-microphone wind-noise suppression system.

The adaptive gain two-microphone wind-noise suppression system implemented using a warped system and combined with the low-frequency attenuation.

HEARING AID WITH SUPPRESSION OF WIND NOISE

RELATED APPLICATION DATA

This application claims priority to and the benefit of Danish Patent Application No. 2005 01107, filed on Aug. 2, 2005.

FIELD

The present application relates to a hearing aid with suppression of wind noise.

BACKGROUND

Wind noise is a serious problem in many hearing aids. Wind noise is caused by turbulent airflow over the microphone(s) in the hearing aid. Turbulence occurs when air flows around any obstacle, so it can never be entirely eliminated in a hearing aid placed on the head. Wind noise is often annoying while listening and can mask desired speech sounds. Severe wind noise can overload the A/D converter or the microphone pre-amplifier. When overload distortion occurs signal processing solutions will be ineffectual since the distortion occurs prior to the digital processing.

An airflow of 5 m/sec (11 miles/hour) will typically generate input-referred one-third-octave band sound-pressure levels of 75 to 100 dB SPL for a hearing aid mounted on a dummy head. The pressures are greatest for the wind at 0 deg (straight ahead), and lowest for the wind at 90 deg.

The wind noise signal has three basic characteristics. First, it is concentrated at low frequencies. The measurements of Wuttke, J. (1991, "Microphones and the wind", J. Audio Eng. Soc, Vol. 40, pp 809-817) for a commercial recording microphone show a spectrum that is relatively flat below 100 Hz and with an approximately −12 dB/octave slope above 100 Hz. The measurements in Dillon, H., Roe, I., and Katch, R. (1999), "Wind noise in hearing aids: Mechanisms and measurements", Nat. Acoustic Labs Australia, Report to Danavox, Phonak, Oticon, and Widex, 13 Jan. 1999 for various hearing aids show a wide variation in the wind-noise spectra, but the general behavior is a one-third-octave spectrum that is relatively flat below 300 Hz and inversely proportional to frequency above 300 Hz.

The spectrum of the wind noise also depends on the wind speed. Recordings of wind noise under a large number of wind conditions using a ReSound Canta 7 BTE attached to a DAT recorder are disclosed in Larsson, P., and Olsson, P. (2004), Master's thesis project, Lund Inst. Tech. The sampling rate was 48 kHz with 16-bit quantization. The recordings were made outdoors as they walked around the city of Lund, Sweden. The separate front and rear microphone signals were recorded simultaneously. Average power spectra for the front microphone for classifications of no wind, low wind speed (audible but not annoying), medium wind speed (troublesome), and high wind speed (uncomfortable or painful) are shown in FIG. 2. Each curve is the average of ten data files (approximately 3 minutes of data) for each wind-speed classification. The power spectra were computed by resampling the files at 16 kHz, applying a 1024-point Hamming window with fifty-percent segment overlap, and averaging the power spectra computed using 1024-point FFTs. The frequency resolution was 16.25 Hz.

The wind speed spectrum for no wind is limited at high frequencies by the noise floor of the hearing aid and recording apparatus, but some wind noise is apparent even for the no-wind condition where it could not readily be perceived. The low wind speed spectrum has a peak at about 32 Hz, and the peak frequency increases to about 100 Hz as the wind speed increases to high. All three curves for the wind present have a high-frequency slope of about −30 dB/decade, which lies between that of a 1-pole and a 2-pole low-pass filter.

The best procedure to reduce wind noise is to place a screen over the microphone ports to reduce the turbulence, and many effective windscreens have been developed for sound-recording microphones (Wuttke, J. (1991), "Microphones and the wind", J. Audio Eng. Soc, Vol. 40, pp 809-817). But a screen may not be practical for a hearing aid given constraints on size or appearance, in which case an algorithmic solution is needed to reduce the wind-noise effects. Assuming that the microphone and pre-amplifier are not overloaded by the wind noise, signal processing can be effective in reducing the annoyance and masking effects. If, however, the major effect of the wind noise is overloading the microphone pre-amplifier, signal processing that occurs after the pre-amplifier will not reduce the noise problems.

Various schemes have been proposed for one-microphone noise suppression. Spectral subtraction (Boll, S. F. (1979), "Suppression of acoustic noise in speech using spectral subtraction", IEEE Trans. Acoust. Speech and Sig. Proc., Vol. 27, pp 113-120), for example, estimates the noise power from the non-speech portions of the signal and subtracts the noise power from the total power in each frequency band. When wind noise is present, it will dominate the low-frequency power estimates, and spectral subtraction will therefore reduce the wind noise. Other techniques, such as reducing the gain in those frequency bands that have a low level of amplitude modulation, will also reduce wind noise. Even though these techniques are not designed specifically for wind-noise reduction, they will reduce the wind noise to some degree.

EP 1 519 626 discloses a system and method for detection and suppression of wind-noise in a hearing aid wherein a converted acoustic signal is processed in a number of frequency bands, a low-frequency band of which is selected as a so-called master band. The signal level of the master band is determined and compared to an absolute threshold value. The signal levels in the other frequency bands are also determined and compared to individual threshold values in each respective band. The signal level in each band is attenuated provided that the signal level in the master band is above the threshold value and the signal level in the band in question is also above its threshold value.

Thus, in EP 1 519 626, a signal level comparison is performed for each frequency band and based on the comparison attenuations in each respective band are performed, however threshold comparison and attenuation in every band is a computationally costly way of detecting and suppressing wind noise.

Further, the threshold comparison may lead to undesirable attenuation in listening situations with a low frequency signal that the hearing-aid user actually desires to hear, for example listening at an outdoor concert to music. Music typically includes low frequency sounds. In such a situation the method disclosed in EP 1 519 626 may undesirably reduce the low frequency gain in response to music of low frequency.

SUMMARY

It is thus an object to provide a wind-noise compensation method in a hearing aid that is computationally simple.

It is a further object to provide a hearing aid that is adapted to compensate for wind-noise.

According to a first aspect of the embodiment, a wind noise compensation method in a hearing aid is provided, comprising the steps of converting sound into an electrical input signal, determining the ratio between the input signal power at first low frequencies and the input signal power at frequencies including frequencies different from the first low frequencies, attenuating the input signal at second low frequencies when the ratio is larger than a threshold, amplifying the resulting electrical signal for compensation of the hearing impairment in question, and converting the amplified signal to sound.

According to a second aspect of the embodiment, a hearing aid is provided comprising a first microphone for conversion of an acoustic sound signal into a first electronic audio signal, a first A/D-converter for conversion of the first audio signal into a first digital signal, a signal processor for digital signal processing of the first digital signal into a digital output signal, including amplification of the first digital signal for compensation of a hearing loss of a wearer of the hearing aid, a D/A converter for conversion of the digital output signal into an audio output signal, and a receiver for conversion of the audio output signal into an acoustic audio signal for transmission towards the eardrum of the wearer of the hearing aid, wherein the signal processor is further adapted to determine the ratio between the input signal power at first low frequencies and the input signal power at frequencies including frequencies different from the first low frequencies whereby presence of wind noise is detected.

Thus, presence of wind noise is detected at frequencies containing a significant part of the actual wind noise.

In one embodiment, the signal processor is a multi-band signal processor wherein the microphone output signal is divided into a set of frequency bands, e.g. utilizing a filter bank, for individual processing of each band-pass filtered signal for compensation of the user'hearing loss. In the following such frequency bands are denoted hearing loss signal processing frequency bands.

In an embodiment, the first low frequencies constitute the lowest hearing loss signal processing frequency band of the signal processor.

In another embodiment, the first low frequencies constitute a separate frequency band of the signal processor.

In the following, frequency bands utilized for wind noise detection are denoted wind noise detection frequency bands, and the first low frequencies may constitute a lowest, and preferably a single, wind noise detection frequency band.

In a preferred embodiment, the signal processor is further adapted to determine the ratio between the input signal power at first low frequencies and the total input power within the bandwidth of the signal processor.

It is an important advantage that a method of wind noise detection is provided including only a single comparison of the input signal power level at first low frequencies with the input signal power level at frequencies that may include the first low frequencies. Thus, the method is computational cost effective and simple. The determination of relative power levels of the input signal reflects the shape of the power spectrum of the signal, and therefore it is another important advantage that typically, the method is capable of distinguishing music from wind noise so that attenuation of desired music is substantially avoided.

In response to detection of presence of wind noise, the signal processor attenuates its output signal at frequencies, namely the second low frequencies, where presence of wind noise affects the quality of the processed audio signal. Typically, the second low frequencies will cover a larger frequency range than the first low frequencies.

Thus, the signal processor may further be adapted to attenuate the first electronic audio signal at second low frequencies in response to the determined ratio whereby suppression of wind noise is provided.

In an embodiment with a multi-band signal processor, the second low frequencies constitutes the two lowest hearing loss signal processing frequency bands of the signal processor.

The signal processor may be adapted to attenuate the second low frequencies of the input signal when the ratio is larger than a threshold.

The hearing aid may further comprise a second microphone with an output connected to a second A/D converter with an output connected to a delay with an output connected to the signal processor, wherein the signal processor is further adapted to subtract the delayed signal from the first digital signal for provision of a hearing aid with a directional characteristic and to attenuate the delayed signal in response to detection of wind noise whereby suppression of wind noise is provided.

Hereby, a hearing aid is provided that is adapted to gradually switch between omni-directional and directional characteristics. In a preferred embodiment of the hearing aid, the hearing aid has a front and a rear microphone, wherein the output of the rear microphone is, preferably gradually, attenuated while leaving the output of the front microphone unaffected. The resulting gradual transition from omni-directional to directional mode is much more pleasant for a user of the hearing aid than the abrupt switching in prior art hearing aids.

The wind noise detection frequency band(s) applied in wind noise detection may be different from the hearing loss signal processing frequency bands applied in the signal amplification for hearing loss compensation. The wind noise detection frequency band(s) may comprise frequencies outside the hearing loss signal processing frequency bands, such as frequencies lower than any of the signal processing frequency bands. In a preferred embodiment, an IIR filter with a low cut-off frequency, e.g. in the frequency range 50 Hz to 500 Hz, such as 150 Hz to 300 Hz, e.g. 200 Hz, provides the first low frequencies.

The frequency bands may be provided utilising warped filters. Preferably, the hearing loss signal processing frequency bands are provided utilising warped filters.

The warped filters may comprise cosine-modulated filters. For a further description of cosine-modulated filters see: P. P. Vaidyanathan "Multirate systems and filter banks" Prentice Hall PTR 1993 (ISBN 0-13-605718-7).

Typically, hearing defects vary as a function of frequency in a way that is different for each individual user. Thus, the signal processor is adapted to divide the input signal into a plurality of hearing loss signal processing frequency bands that may be processed differently, e.g. amplified with different gains. Thus, the signal processor is adapted to provide a filter bank with band pass filters for dividing the first digital signal into a set of band pass filtered first digital signals for possible individual processing of each of the band pass filtered signals. The signal processor is further adapted to add the processed signals into the digital output signal.

The signal processor may have adjustable gains as a function of frequency, e.g. in the hearing loss signal processing frequency bands of a multi-band processor, whereby a frequency response shaping system is provided, preferably with high resolution, for frequency dependent hearing impairment compensation. The gains are determined by audiological measurements, such as determination of hearing threshold as a function of frequency, during initial adaptation of the hearing aid to a user.

The filter bank of a multi-band processor may comprise a minimum phase filter for provision of a minimum group delay. Preferably, the filter bank comprises a high-resolution minimum-phase Finite Impulse Response (FIR) filter. Minimum-phase FIR filtering is a digital filtering technique that is particularly suitable for both continuous and transient signal processing, and it offers the lowest possible processing delay in a digital application. Further, it is believed that minimum-phase FIR filtering processes transient sounds in a way that correspond better to auditory system processing than other digital filter techniques.

The filter bank of the signal processor may comprise warped filters leading to a low delay, i.e. the least possible delay for the obtained frequency resolution, and adjustable crossover frequencies of the filter bank.

The signal processor may comprise a multi-band power estimator for calculation of the power at the first low frequencies and in the total frequency range of the signal processor. Based on the determination, the ratio between the input signal power at the low frequencies and the total input signal power is determined whereby presence of wind noise is detected. When the ratio is above a predetermined threshold, wind noise is deemed to be present. The threshold ranges from 2% to 20%, and preferably the threshold is 5%.

Preferably, the signal processor gain in a hearing loss signal processing frequency band is calculated and applied for a block of samples whereby required processor power is lowered. When the signal processor operates on a block of signal samples at the time, the signal processor gain control unit operates at a lower sample frequency than other parts of the system. This means that the signal processor gains only change every N'th sample where N is the number of samples in the block. This may generate artefacts in the processed sound signal, especially for fast changing gains. In an embodiment, these artefacts are suppressed by provision of low-pass filters at the gain outputs of the signal processor gain control unit for smoothing gain changes at block boundaries.

It should be noted that in an embodiment, the hearing loss signal processing frequency bands of the signal processor are adjustable and may be adapted to the specific hearing loss in question. For example, frequency warping enables variable crossover frequencies in the signal processor filter bank. Depending on the desired gain settings, the crossover frequencies may be automatically adjusted to best approximate the response.

It is an important advantage that the fact that wind noise is concentrated at very low frequencies is utilized in detection of wind noise and in suppression of wind noise. In one embodiment, the gain at low frequencies is reduced when a high level of low-frequency power is detected, and wind noise reduction of 20 dB or more is possible.

BRIEF DESCRIPTION OF THE DRAWINGS

Below, the embodiments will be further described and illustrated with reference to the accompanying drawings in which:

FIG. 2 is a plot of power spectra for different intensities of wind noise,

DETAILED DESCRIPTION OF EMBODIMENTS

Figure 1:
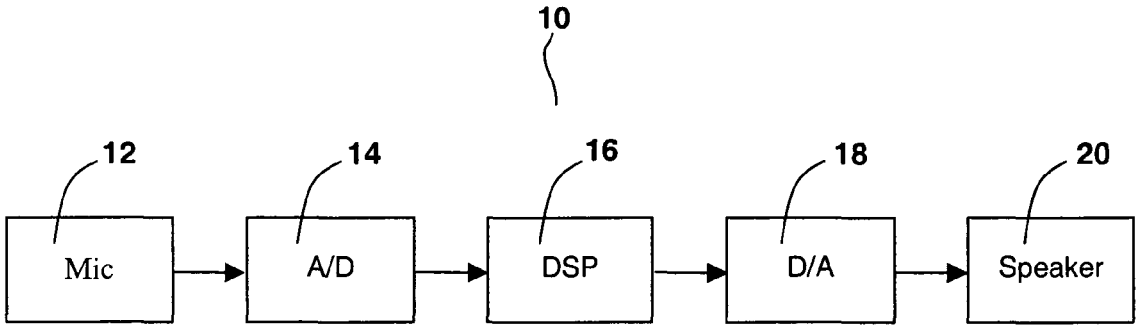
FIG. 1 is a block diagram of a hearing aid.

FIG. 1 is a simplified block diagram of a digital hearing aid 10 according to some embodiments. The hearing aid 10 comprises an input transducer 12, preferably a microphone, an analogue-to-digital (A/D) converter 14, a signal processor 16 (e.g. a digital signal processor or DSP), a digital-to-analogue analogue (D/A) converter 18, and an output transducer 20, preferably a receiver. In operation, input transducer 12 receives acoustical sound signals and converts the signals to analogue electrical signals. The analogue electrical signals are converted by A/D converter 14 into digital electrical signals that are subsequently processed by DSP 16 to form a digital output signal. The digital output signal is converted by D/A converter 18 into an analogue electrical signal. The analogue signal is used by output transducer 20, e.g., a receiver, to produce an audio signal that is heard by the user of the hearing aid 10. The signal processor 16 is adapted to provide a filter bank with band pass filters for dividing the first digital signal into a set of band pass filtered first digital signals for possible individual processing of each of the band pass filtered signals. The signal processor 16 is further adapted to add the processed signals into the digital output signal.

Figure 3:
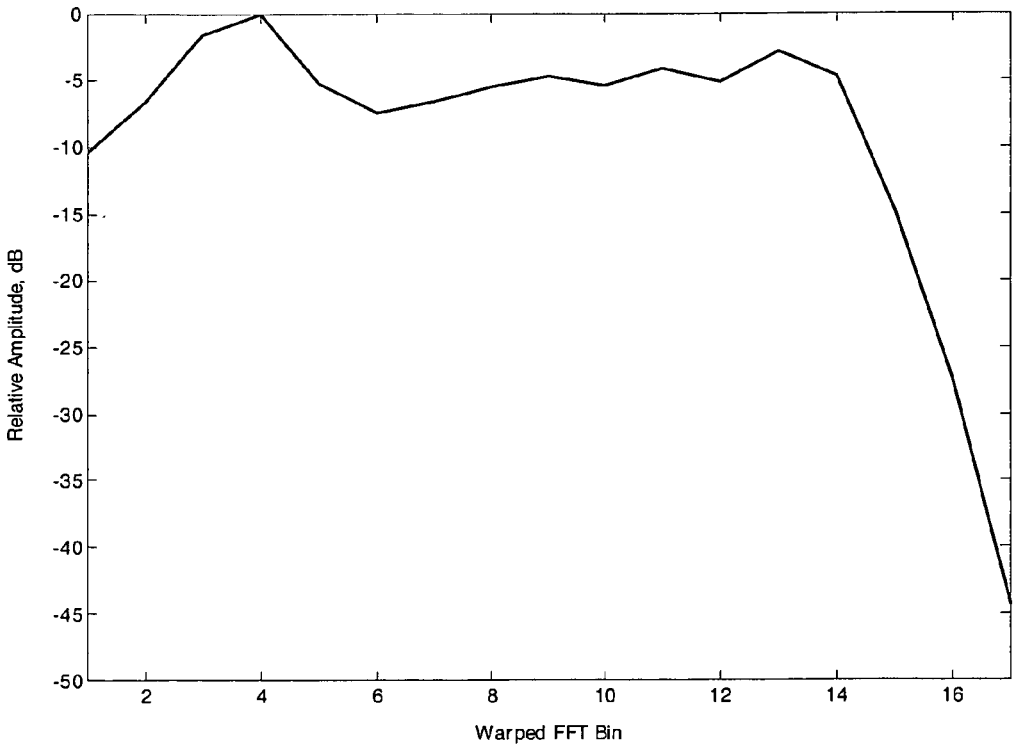
FIG. 3 is a plot of a long term frequency warped power spectrum for a section of the "Rainbow Passage" spoken by a male talker.

Wind noise suppression according to the illustrated embodiment is based on the spectral characteristics of the wind noise. The long-term spectrum of a segment of the "Rainbow Passage" spoken by a male talker is plotted in FIG. 3. The spectral analysis is performed by the hearing aid signal processor providing 17 hearing loss signal processing frequency bands from a warped 32-point FFT with a warping parameter of a=0.5. Frequency bands 1 through 4 correspond to center frequencies of 0, 167, 337, and 513 Hz at the 16-kHz sampling rate. The speech signal power in band 1 is relatively low, and the speech power is highest in bands 3 and 4.

Figure 4:
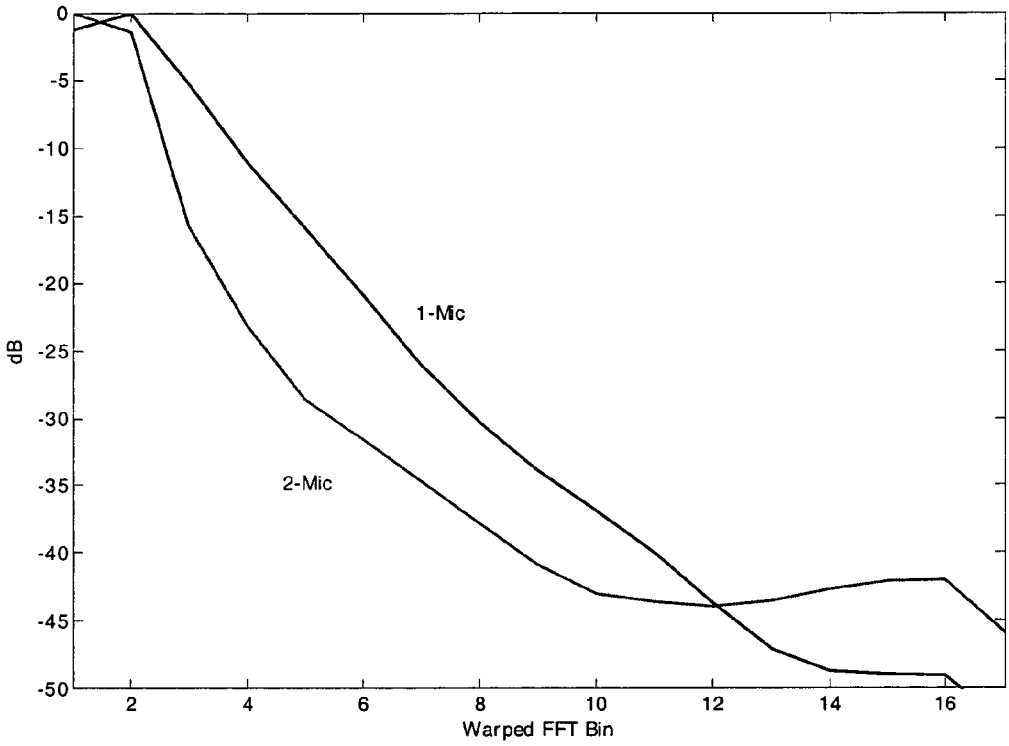
FIG. 4 is a plot of long term frequency warped power spectra of wind noise.

In contrast to the speech spectrum, the long-term spectra for two samples of wind noise are plotted in FIG. 4. The wind noise was recorded using a ReSound Canta 770D BTE worn on the head outdoors during a period of strong winds. The wind speed was approximately 15 m/sec (34 miles/hour) with a fluctuating wind direction. The noise files were for an omni directional microphone and for a 2-microphone directional array. The one-microphone wind noise has its maximum at band 2 (167 Hz) and the two-microphone wind noise has its maximum at band 1 (0 Hz). The two-microphone wind noise power decreases more rapidly with increasing frequency than the one-microphone power, but this is more likely the result of the fluctuations in the wind velocity than the result of the array response differences.

In comparing the spectra of speech with wind noise, the speech has much more power at high frequencies than does the wind noise, and the wind noise has much more power in bands 1 and 2 than does the speech. One proposed criterion for detecting wind noise is the relative power in frequency band 1 (0 Hz). The fraction of the total signal power in band 1 is given by $$p(m) = \frac{|X(m,1)|^2}{\sum_{k=1}^{17} |X(m,k)|^2} \tag{1}$$

$$q(m) = \alpha q(m-1) + (1-\alpha)p(m)$$

where $|X(m,k)|^2$ is the spectral power of the input signal x(n) in band k for block m. The power fraction p(m) is then low-pass filtered with a time constant $\alpha$ of e.g. 50 ms to give the LP-filtered power fraction q(m).

Figure 5:
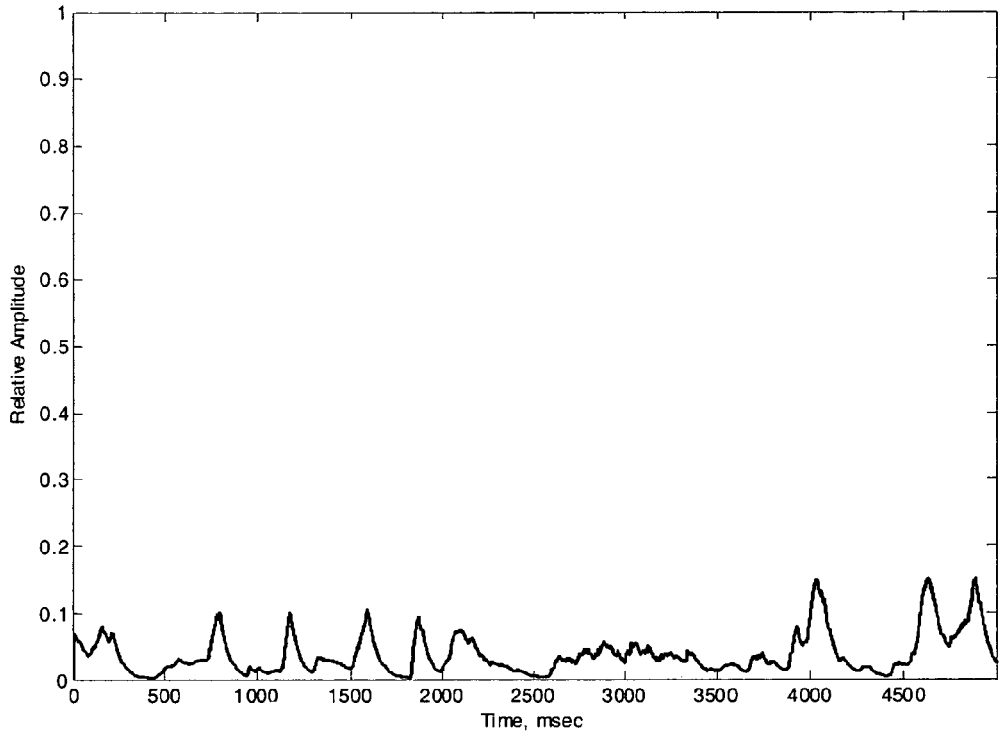
FIG. 5 is a plot of the fraction of the total signal power found in the lowest frequency warped FFT band for a section of the "rainbow Passage" spoken by a male talker.
Figure 6:
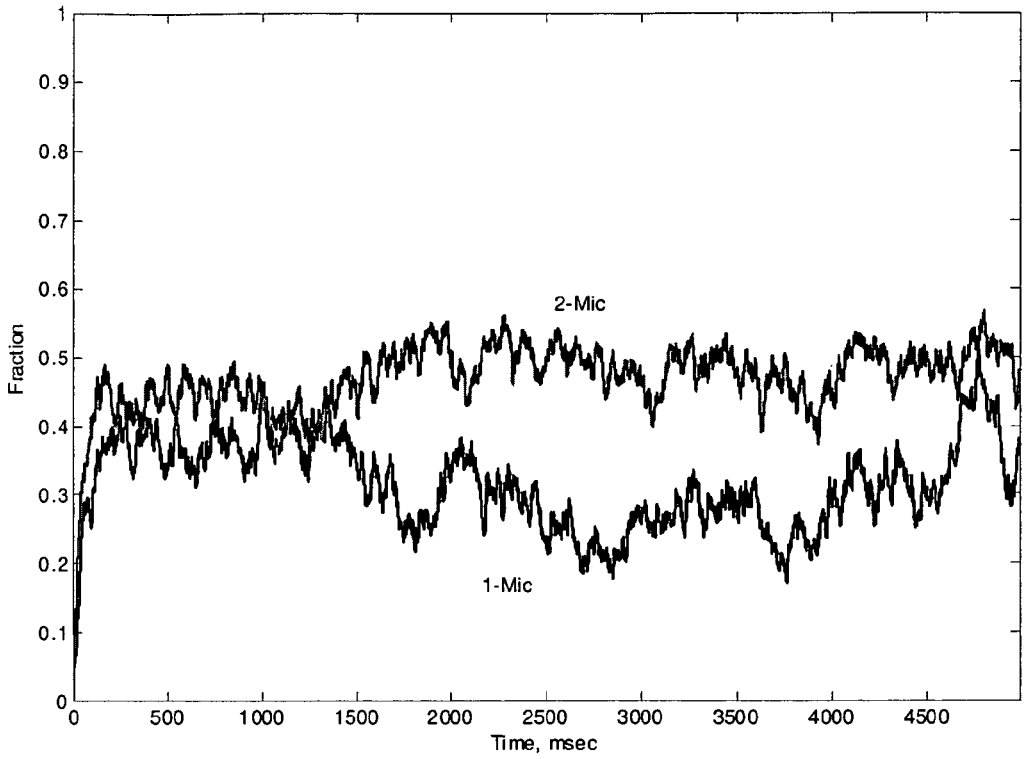
FIG. 6 is a plot of the total signal power found in the lowest frequency warped FFT band for wind noise.
Figure 7:
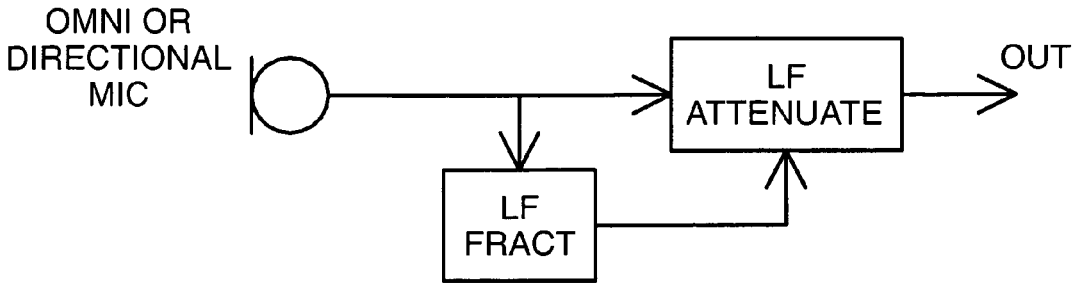
FIG. 7 is a blocked schematic of a hearing aid with wind noise suppression.
Figure 8:
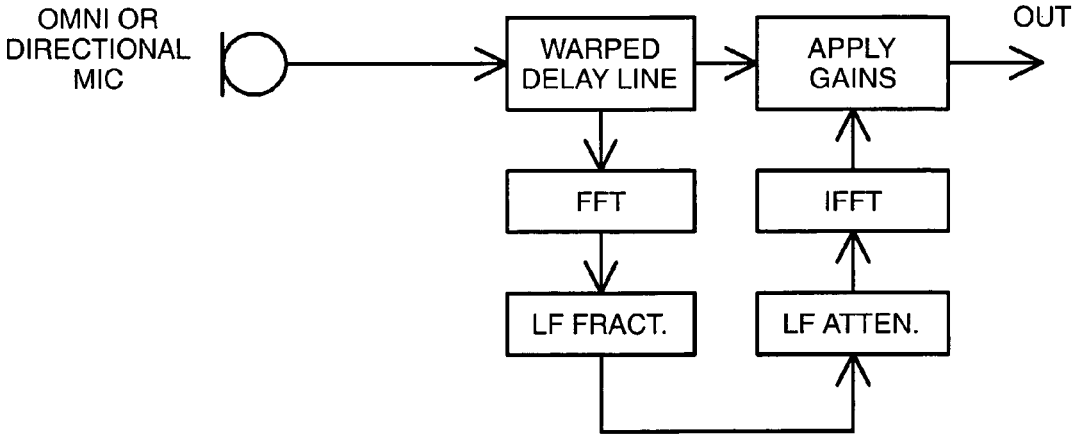
FIG. 8 is a blocked schematic of a hearing aid with wind noise suppression and warped filters.

The band 1 low-pass filtered power fraction q(m) is plotted in FIG. 5 for the speech segment and in FIG. 6 for the two wind-noise segments. For the speech, the fraction q(m) rarely rises above 0.1, while for wind noise the fraction q(m) rarely falls below 0.2. Thus most of the wind-noise power can be suppressed by attenuating frequency bands 1 and 2, which will also reduce the masking of speech in higher frequency bands by the low-frequency wind noise. A preferred suppression algorithm is then $$A(m,1) = \begin{cases} 0\text{ dB}, & q(m) < \theta_0 \\ A_{max}\dfrac{q(m)-\theta_0}{\theta_1-\theta_0}\text{ dB}, & \theta_0 \le q(m) \le \theta_1 \\ A_{max}\text{ dB}, & q(m) > \theta_1 \end{cases} \tag{2}$$

$$A(m,2) = \frac{1}{2}A(m,1)$$

where A(m,1) and A(m,2) are the attenuations in dB for frequency bands 1 and 2, $\theta_0 \approx 0.05$ is the threshold for speech, $\theta_1 \approx 0.20$ is the threshold for wind noise, and $A_{max}$ is the maximum amount of attenuation desired. A block diagram of the suppression algorithm is presented in FIG. 7, and an implementation with warped filter bank architecture is presented in FIG. 8.

The fraction of the total signal power at low frequencies is an effective statistic for separating speech from wind noise. However, automobile traffic noise is also concentrated at low frequencies. The long-term spectrum for a 7-sec segment of traffic noise is plotted in FIG. 9, and the low-pass filtered power fraction of the warped spectrum is plotted in FIG. 10. The traffic noise behaves very much like the wind noise, with most of the signal power concentrated in the lowest-frequency band. Thus any operation based on the power fraction q(m) will affect traffic noise as well as wind noise. For a hearing aid with a single microphone, the reduction of low-frequency gain with increasing low-frequency power fraction may be beneficial in reducing traffic noise as well as wind noise.

Figure 11:
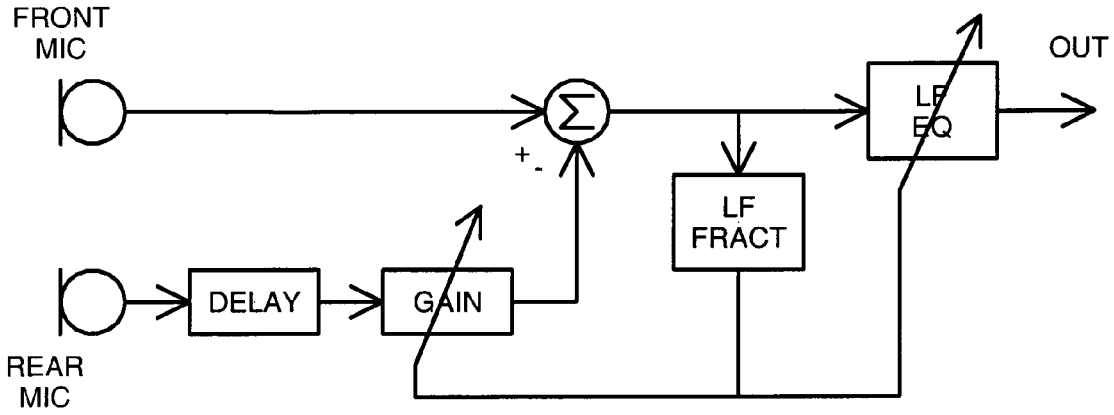
FIG. 11 is a blocked schematic of a hearing aid with two microphones and wind noise suppression.

An embodiment with two microphones is shown in FIG. 11. The front and rear microphones are combined to give a directional response, but the gain of the rear microphone can be adjusted to change the response. A rear-microphone gain of 1 gives the full directional behavior, while reducing the rear gain to 0 gives the omni directional response from the front microphone alone. The rear-microphone gain is controlled by the wind-noise detector, which in this case is the low frequency power fraction defined by Eq. (1). The directional microphone has inherent low-frequency attenuation, and an equalization filter is usually provided to produce a flat frequency response for signals coming from the front. The low-frequency equalization filter is also adjusted to provide the correct frequency-response compensation as the rear microphone gain is adjusted.

The algorithm for the wind-noise suppression is very simple. The gain for the rear microphone is set to 1 when the low-frequency power fraction of the combined front plus rear microphone signal is below a lower threshold $\phi_0$, and is set to 0 when the low-frequency power fraction is above an upper threshold $\phi_1$. In between these limits the rear-microphone gain varies linearly with the power fraction. The algorithm is then $$g_{rear}(m) = \begin{cases} 1, & q(m) < \phi_0 \\ \dfrac{\phi_1 - q(m)}{\phi_1 - \phi_0}, & \phi_0 \le q(m) \le \phi_1 \\ 0, & q(m) > \phi_1 \end{cases} \tag{3}$$

where $\phi_0 \approx 0.04$ is the threshold for speech and $\phi_1 \approx 0.12$ is the threshold for wind noise.

The low-frequency equalization filter needs to vary as the rear microphone gain varies, and is given by:

$$EQ(m) = \frac{1}{1+g_{rear}(m)} \times \frac{1}{1-0.99\ g_{rear}(m)z^{-1}} \tag{4}$$

The first term in Eq. (4) adjusts the overall amplitude to give unit gain as the rear microphone gain changes. The second term in Eq. (4) corrects the low-frequency response.

Figure 12:
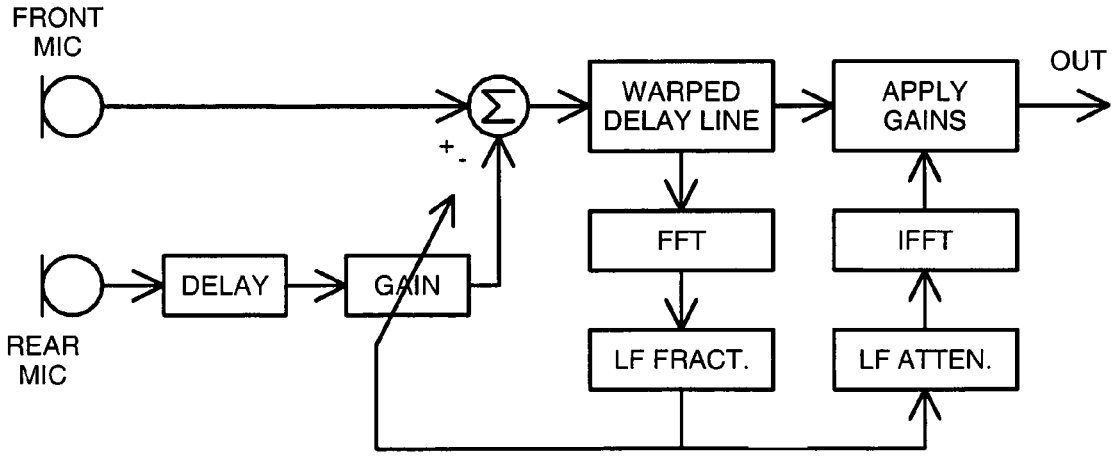
FIG. 12 is a blocked schematic of a hearing aid with two microphones and wind noise suppression and warped filters.

The algorithm can also be combined with the low-frequency attenuation of the previous algorithm. This combined approach, implemented using the warped filter bank architecture, is shown in FIG. 12. The "LF ATTEN" block combines the low-frequency equalization function of Eq. (4) with the attenuation provided by Eq. (2).

Figure 9:
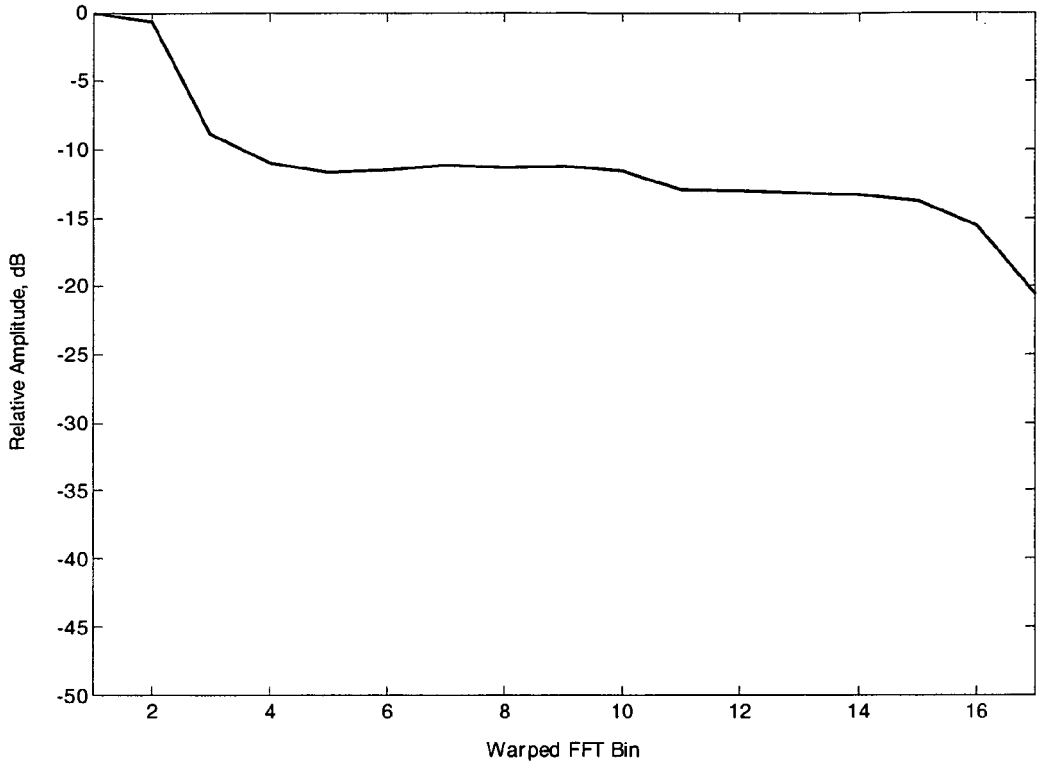
FIG. 9 is a plot of a long term frequency warped power spectrum for automobile traffic noise.
Figure 10:
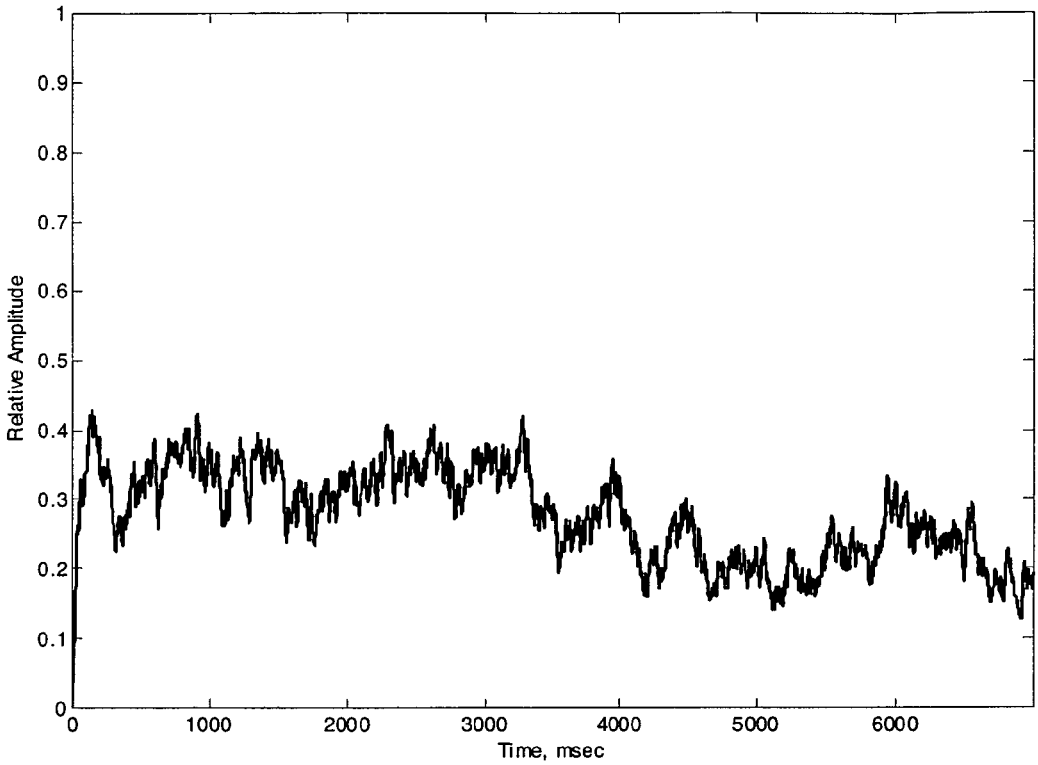
FIG. 10 is a plot of the total signal power found in the lowest frequency warped FFT band for automobile traffic noise.

The plots of FIGS. 9 and 10 showed that automobile traffic noise has spectral properties similar to wind noise. In the presence of traffic noise, therefore, the algorithm given by Eqs. (3) and (4) will switch the microphone directional pattern from directional to omni directional. This change in the microphone directional response may increase the amount of traffic noise because the depth of any nulls in the microphone directional response will be reduced.

In the illustrated embodiments, the wind noise detection frequency band is identical to the lowest hearing loss signal processing frequency band; however the wind noise detection frequency band may also be formed by concatenating two or more of the lowest hearing loss signal processing frequency bands.

Alternatively, the wind noise detection frequency band is different from any of the hearing loss signal processing frequency bands. In such an embodiment, the wind noise detection frequency band may be formed by an IIR filter with an adjustable cut-off frequency of 50 Hz to 500 Hz, preferably a $2^{nd}$ order IIR filter. The second order filter is the simplest filter with the required roll-off. Higher order filters may be utilized. A FIR filter may also be utilized. Further, the wind noise detection frequency band may comprise frequencies outside the hearing loss signal processing frequency bands, such as frequencies below any of the signal processing frequency bands.

The invention claimed is:

1. A hearing aid comprising:

a first microphone for conversion of an acoustic sound signal into a first electronic audio signal, a first A/D-converter for conversion of the first electronic audio signal into a first digital signal, a signal processor for digital signal processing of the first digital signal into a digital output signal, including amplification of the first digital signal for compensation of a hearing loss of a wearer of the hearing aid, a D/A converter for conversion of the digital output signal into an audio output signal, and a receiver for conversion of the audio output signal into an acoustic audio signal for transmission towards an eardrum of the wearer of the hearing aid, wherein the signal processor is further configured to determine a ratio between a first power of the first digital signal at first frequencies and a second power of the first digital signal at second frequencies to thereby detect a presence of wind noise wherein the first frequencies includes a frequency that is lower than a frequency in the second frequencies.

2. The hearing aid according to claim 1, wherein the signal processor is a multi-band signal processor.

3. The hearing aid according to claim 2, wherein the first low frequencies constitute the lowest hearing loss signal processing frequency band of the signal processor.

4. The hearing aid according to claim 1, wherein the second frequencies also include the first frequencies.

5. The hearing aid according to claim 1, wherein the signal processor is further configured to attenuate the first electronic audio signal at third frequencies in response to the determined ratio whereby suppression of wind noise is provided.

6. The hearing aid according to claim 5, wherein the signal processor is a multi-band signal processor, and the first and third frequencies constitute the two lowest hearing loss signal processing frequency bands of the signal processor.

7. The hearing aid according to claim 5, wherein the signal processor is a multi-band signal processor and the signal processor is configured to attenuate the lowest hearing loss signal processing frequency band signal when the ratio is larger than a threshold.

8. The hearing aid according to claim 1, further comprising a second microphone with an output connected to a second A/D converter with an output connected to a delay with an output connected to the signal processor, wherein the signal processor is further adapted to subtract a delayed signal from the first digital signal for provision of a hearing aid with a directional characteristic and to attenuate the delayed signal in response to the detection of the wind noise whereby suppression of the wind noise is provided.

9. The hearing aid according to claim 2, wherein the processor is configured to use the frequency bands for the wind noise detection that are different from frequency bands for the amplification of the first digital signal for the hearing loss.

10. The hearing aid according to claim 2, wherein the multi-band signal processor comprises warped filters.

11. The hearing aid according to claim 10, wherein the warped filters comprise cosine-modulated filters.

12. A method in a hearing aid, comprising:

converting input sound into an electrical input signal, determining a ratio between a first power of the electrical input signal at first frequencies and a second power of the electrical input signal at second frequencies wherein the first frequencies include a frequency that is lower than a frequency in the second frequencies, attenuating the electrical input signal when the ratio is larger than a threshold, amplifying the attenuated signal for compensation of a hearing impairment, and converting the amplified signal to output sound.

13. The method of claim 12, wherein the first frequencies comprise first low frequencies, and wherein the act of attenuating the electrical input signal comprises attenuating the electrical input signal in second low frequencies.

14. The method of claim 12, wherein act of amplifying is performed using a multi-band signal processor.

15. The method of claim 14, wherein the multi-band signal processor comprises warped filters.

16. The method of claim 15, wherein the warped filters comprise cosine-modulated filters.

17. The method of claim 14, wherein the first frequencies constitute the lowest hearing loss signal processing frequency band of the signal processor.

18. The method of claim 12, wherein the second frequencies also include the first frequencies.

19. The method of claim 12, wherein the act of attenuating results in a suppression of wind noise.

20. The method of claim 12, wherein the act of attenuating the electrical input signal comprises attenuating the lowest hearing loss signal processing frequency band signal when the ratio is larger than the threshold.

21. The method of claim 12, wherein the act of determining the ratio is performed to detect wind noise, and wherein the wind noise detection uses frequency bands that are different from frequency bands for the act of amplifying.

22. The hearing aid according to claim 12, wherein the first frequencies are lower than at least some of the second frequencies.

23. The hearing aid according to claim 1, wherein the first frequencies are lower than at least some of the second frequencies.

* * * * *